US006679380B2

(12) United States Patent
Brown

(10) Patent No.: US 6,679,380 B2
(45) Date of Patent: Jan. 20, 2004

(54) CUP CARRIER

(75) Inventor: Eric Brown, Benton, ME (US)

(73) Assignee: Huhtamaki Foodservice, Inc., Waterville, ME (US)

( * ) Notice: Subject to any disclaimer, the term of this patent is extended or adjusted under 35 U.S.C. 154(b) by 25 days.

(21) Appl. No.: 09/891,489

(22) Filed: Jun. 26, 2001

(65) Prior Publication Data

US 2002/0195371 A1 Dec. 26, 2002

(51) Int. Cl.[7] ..... B65D 1/34

(52) U.S. Cl. ..... 206/427; 206/563; 220/503; 229/406; 229/904

(58) Field of Search ..... 206/139, 175, 206/203, 427, 562, 563; 220/503; 229/406, 407, 904

(56) References Cited

U.S. PATENT DOCUMENTS

| | | | | | |
|---|---|---|---|---|---|
| 1,673,869 | A | | 6/1928 | Fulton et al. | |
| 1,754,713 | A | | 4/1930 | Green | |
| D122,589 | S | | 9/1940 | Bastress | |
| 2,314,935 | A | | 3/1943 | Gutterman | |
| 2,321,519 | A | | 6/1943 | Rubinoff | |
| 2,466,636 | A | | 4/1949 | Bruckner et al. | |
| D170,163 | S | | 8/1953 | Randall | |
| D170,164 | S | | 8/1953 | Randall | |
| D170,237 | S | | 8/1953 | Randall | |
| D170,338 | S | | 9/1953 | Randall | |
| D171,104 | S | | 12/1953 | Randall | |
| 2,670,124 | A | | 2/1954 | Buchmiller et al. | |
| D176,035 | S | | 11/1955 | Randall | |
| 2,766,919 | A | | 10/1956 | Randall | |
| D179,780 | S | | 2/1957 | Randall | |
| 2,826,346 | A | | 3/1958 | Randall | |
| 2,828,047 | A | * | 3/1958 | Weiselberg | 206/562 |
| 2,924,372 | A | * | 2/1960 | Kirkeby | 206/563 |
| D236,575 | S | | 9/1975 | Vigue | |
| 3,915,371 | A | | 10/1975 | Crabtree | |
| D249,620 | S | | 9/1978 | Vigue | |
| D249,622 | S | | 9/1978 | Vigue | |
| D249,769 | S | | 10/1978 | Vigue | |
| D250,243 | S | | 11/1978 | Vigue | |
| D253,561 | S | | 12/1979 | Vigue | |
| 4,573,586 | A | * | 3/1986 | Helmer | 206/563 |
| 4,782,943 | A | * | 11/1988 | Blackman | 206/175 |
| 4,796,791 | A | * | 1/1989 | Goss et al. | 206/562 |
| D352,893 | S | * | 11/1994 | Legacy et al. | D9/341 |
| 5,609,379 | A | * | 3/1997 | Harrelson | 206/427 |

* cited by examiner

*Primary Examiner*—Jim Foster
(74) *Attorney, Agent, or Firm*—Shook, Hardy & Bacon, LLP

(57) ABSTRACT

A cup carrier is described which has an integrally formed body portion having a base, walls and four cup-holding openings, wherein two of the cup holding openings define a first pair and two cup holding openings define a second pair, and the first pair of cup holding openings is provided at a first level relative to the base, and the second pair of openings is provided at a second level from the base which is higher from the base than the first level. The openings in one pair of the cup holding openings can be differently sized than the cup holding openings in the other pair to accommodate different sizes of drink cups.

10 Claims, 1 Drawing Sheet

CUP CARRIER

FIELD OF THE INVENTION

The invention relates to a cup carrier for holding and transporting beverage cups.

BACKGROUND AND PRIOR ART

Carry trays for holding and carrying beverage cups are well-known and are in widespread use in carry out food restaurants, stadiums, convenience stores, coffee shops and the like.

Typically, the trays comprise a main body portion provided with a number of cup-holding sockets. The number of cup holding sockets can vary, depending on the style of the cup carrier. Moreover, it is known to configure the cup-holding sockets so as to firmly accommodate drinking cups of different sizes. An example of a versatile cup-holding socket is shown in U.S. Pat. No. 4,218,008 to Vellieux, which structure involves flexible members in the sockets which deflect as the cup is inserted and exert a stabilizing force on the sides of the cup. Another approach has been to provide sockets of different sizes on the same cup carrier, as shown for example in U.S. Pat. No. 5,096,065 to Vigue.

SUMMARY OF THE INVENTION

The invention provides for a cup carrier comprising a main body portion, and cup-holding openings provided in the main body portion. Preferably four cup-holding openings are provided. The upper-surface of the body portion is multi-leveled. When four openings are present, a first pair of the cup-holding openings are provided at a first level relative to the base of the body portion, and a second pair of the cup-holding openings are provided at a second level relative to the base of the body portion, with the second level being higher from the base than the first level. Preferably, the pairs of cup-holding openings are differently sized, to allow insertion of both larger and smaller sizes of cups.

DESCRIPTION OF THE DRAWING FIGURES

DESCRIPTION OF THE PREFERRED EMBODIMENTS

Figure 1:
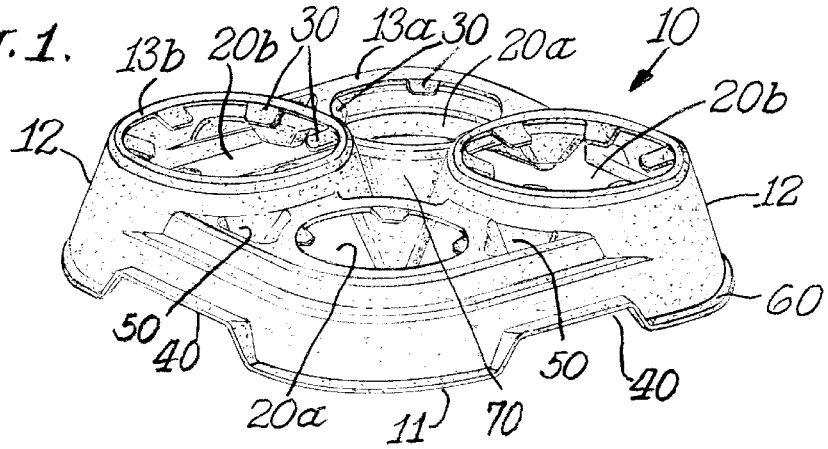
FIG. 1 is a perspective view of a currently-preferred embodiment of a cup carrier.

Referring to the figures, the cup carrier of the invention comprises a body portion 10, which in the illustrated embodiments, is a unitary, molded three-dimensional structure. In preferred form, the body portion is molded as a unitary, contoured article from a rigid material, such as molded pulp fiber. An outer flange 60 may surround the entire outer edge of the cup carrier body, to add stability and facilitate grasping.

As an alternative to molded pulp fiber, the body portion may be formed from thermoplastic or a different rigid material.

The body portion 10 comprises a base 11, sides 12, first level 13*a,* and second level 13*b.*

As seen in the Figures, the cup carrier is provided with four cup-holding openings, which comprise a first pair of openings 20*a* and second pair of openings 20*b.* The first pair of openings 20*a* are provided at the first level 13*a,* and the second pair of openings are provided at the second level 13*b.* As shown, the two cup-holding openings of the first pair of openings are provided across the center of the tray from one another, and similarly, the two cup-holding openings in the second pair are provided across the center of the tray from one another. The bi-leveling of the cup carrier upper surface as described has been found to improve the strength of the carrier when carrying full drinking cups.

In a preferred embodiment, the two pairs of cup-holding openings have different sizes. That is, the cup-holding openings comprising the first pair 20*a* are sized to be the same size as each other, but different in size from the openings comprising the second pair of openings 20*b.* In the embodiment shown, the openings 20*a* are smaller than the openings 20*b.* So configured, the openings 20*b* in the second level are larger than the openings 20*a* in the first level.

The particular size of the openings should be determined based on the size of drinking cups to be held. Based on currently popular drinking cup sizes, it is preferred that the openings 20*a* have a diameter d1 of about 2 9/16 inches, and that the openings 20*b* have diameter d2 of about 3 1/8 inches.

Provided at the periphery of each of the cup-holding openings are flexible tabs 30. Preferably, the tabs are formed integrally with the base. The tabs 30 are stiff, but can yield when a cup is forced into the opening. Thus, the tabs act to stabilize a cup which is inserted into the cup-holding opening. To facilitate their bending, the tabs are formed so as to have a downward slant or curvature towards the center of the opening. The number and configuration of tabs is variable and depends on the size and shape of the cups to be carried. In the illustrated embodiment, larger openings 20*b* are provided with six tabs, and smaller openings 20*a* are provided with four tabs.

Figure 2:
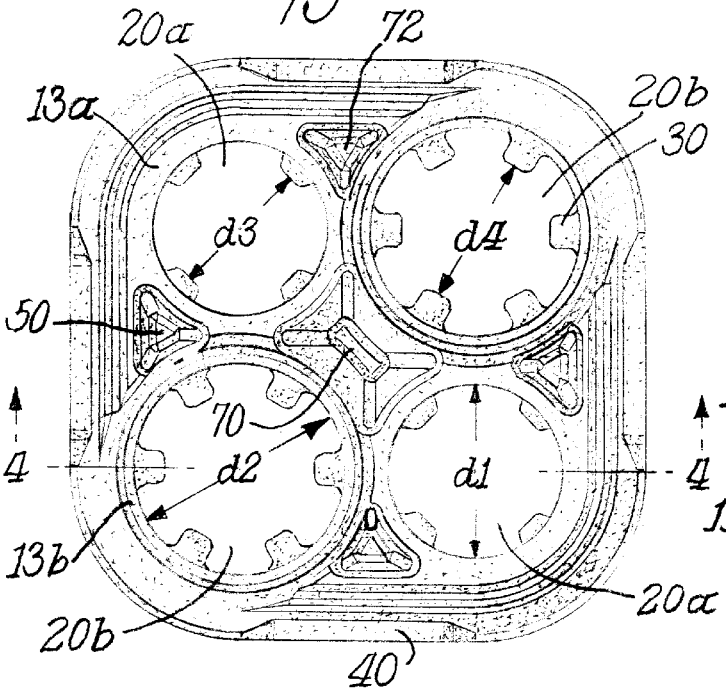
FIG. 2 is top plan view of the embodiment of FIG. 1.
Figure 3:
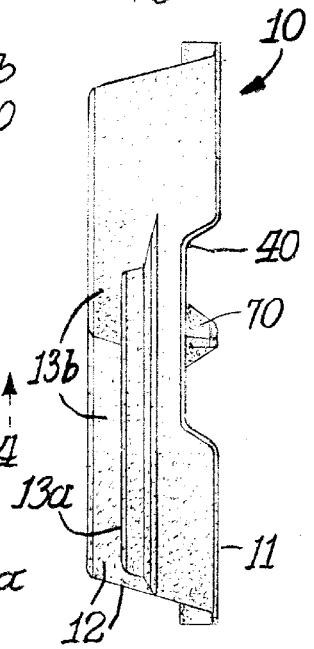
FIG. 3 is a side elevational view of the embodiment of FIG. 1.
Figure 4:
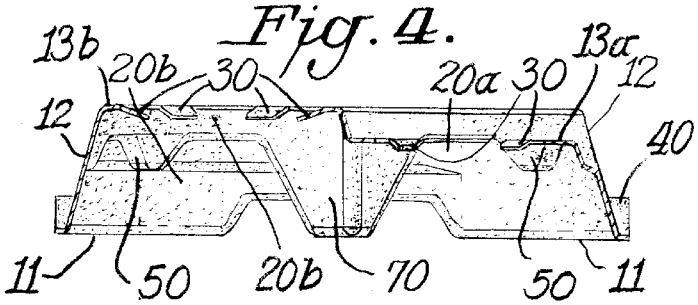
FIG. 4 is a cross-sectional view in elevation taken along line 4—4 of FIG. 2.

It should be noted that, in some sizes of cups, the cup will tend to settle against the outer edges of tabs 30, and be stably held. The edges of the tabs 30 thus define inner dimensions to each cup-holding opening. As shown in FIG. 2, the edges of the tabs define a diameter d3 in the openings 20*a,* and a diameter d4 in openings 20*b.* Based on currently popular drinking cup 14 sizes, it is preferred that the openings 20*a* have a diameter d3 of about 2 1/16 inches, and that the openings 20*b* have diameter d4 of about 2 1/8 inches.

As can be seen from the drawings, the tabs 30 are positioned at essentially the level of the cup-holding opening with which they are associated, and project from the periphery of the opening towards the center of the opening. When a cup is inserted, it is grasped and stabilized by the tabs at the same level as the opening. This provides stabilization higher on the cup sidewall than some prior designs, where the cup was grasped by deflectable members located at a lower position in a cup socket. Grasping the cups higher on their sidewalls tends to improve the stability of the cup carrier when loaded with filled drink cups.

The configuration of openings and tabs as shown is versatile for holding different sizes of cups. Many different sizes of cups can be stably held. Any size of cup which is inserted can be lowered into the cup-holding opening until, at some diameter, the sidewall of the cup is held either by the edges of the tabs or, for a larger cup, by the outer edge of the cup-holding opening with the tabs fully deflected. By appropriate choice of dimensions, it can be assured that the more common sizes of cups are securely held by the tabs when inserted such that the bottom of the cup reaches the level of the base of the cup carrier. That way, when the filled cup carrier is placed on a flat surface, the bottom of a cup which is fully inserted in the cup-holding opening will rest on the same flat surface, providing a very stable arrangement of the cups in the carrier.

One or more of the lower edges of the cup carrier can be provided with an integral slot 40, to facilitate picking up and holding the cup carrier. Situated on the first level 13*a* in association with the slot is a depression 50, into which the user's thumb may be inserted. To easily carry the cup carrier, the thumb is inserted into depression 50 and the remaining fingers wrap to below the carrier in slot 40. Preferably, each side of the cup carrier is provided with a slot, a depression or both. Alternatively, the fingers can extend under the tray such that the user's fingers push against the center downpost.

Provided in the center of the tray, and separating each of the pairs of cup-holding openings, is center downpost 70. The center downpost is formed integrally with the cup carrier, and extends from the first level 13*a* to the base level 11. Thus, when the cup carrier is positioned on a flat surface, the center downpost rests on the flat surface to further stabilize the cup carrier.

As persons skilled in the art will appreciate, the cup carrier may be formed in common dimensions which are generally known in the industry. In overall dimensions, the cup carrier may be square, having a length and width of about 8½ inches. The height from the base to the first level is about 1⅜ inches, and the height from the base to the second level is about 1⅞ inches.

When formed as described, the cup carrier has advantages of small size, excellent strength and stability, low cube size, and easy denesting.

Further modifications and variations of the illustrated embodiments will be apparent to those skilled in the art.

What is claimed is:

1. A cup carrier comprising a body portion molded as a unitary, contained article and having a base, walls and four cup-holding openings, wherein:

two cup holding openings comprise a first pair and two cup holding openings comprise a second pair;

the first pair of cup holding openings is provided at a first level relative to the base, and the second pair of openings is provided at a second level from the base which is higher from the base than the first level;

and wherein the members of each pair of cup-holding openings face each other across the center of the cup carrier.

2. The cup carrier of claim 1, wherein the pairs of cup holding openings have different sizes.

3. The cup carrier of claim 2, wherein the pair of cup holding openings at the first level are smaller than the pair of cup holding openings at the second level.

4. The cup carrier of claim 1, wherein integral, deflectable tabs are provided in the cup holding openings.

5. The cup carrier of claim 3, wherein integral, deflectable tabs are provided in the cup holding openings.

6. The cup carrier of claim 1, further comprising a central downpost provided in substantially the center of the tray, which extends from the first level to the base level of the cup carrier.

7. The cup carrier of claim 3, further comprising a central downpost provided in substantially the center of the tray, which extends from the first level to the base level of the cup carrier.

8. The cup carrier of claim 1, further comprising a slot positioned on the cup carrier on at least one side of the cup carrier to facilitate grasping.

9. The cup carrier of claim 8, further comprising a depression associated with the slot, provided at the first level of the cup carrier.

10. A cup carrier comprising a body portion having a base, walls and four cup-holding openings, wherein:

two cup holding openings comprise a first pair and two cup holding openings comprise a second pair;

the first pair of cup holding openings is provided at a first level relative to the base, and the second pair of openings is provided at a second level from the base which is higher from the base than the first level;

wherein the members of each pair of cup-holding openings face each other across the center of the cup carrier;

the openings comprising the first pair of cup holding openings are smaller than the openings comprising the second pair of cup holding openings; and the openings are provided with deflectable tabs which project inwardly from the outer periphery of the openings.

* * * * *